US006050846A

United States Patent [19]

Wang

[11] Patent Number: 6,050,846

[45] Date of Patent: Apr. 18, 2000

[54] LAMPSOCKET WITH NON-DEFORMING TERMINAL

[76] Inventor: Wan-Chen Wang, No. 29, Lane 85, Hwa Chian Street, Hsinchu City, Taiwan

[21] Appl. No.: 09/249,145

[22] Filed: Feb. 12, 1999

[51] Int. Cl.[7] ..... H01R 4/24; H01R 4/26; H01R 11/20

[52] U.S. Cl. ..... 439/419; 439/575

[58] Field of Search ..... 439/419, 575

[56] References Cited

U.S. PATENT DOCUMENTS

| | | | |
|---|---|---|---|
| 5,380,215 | 1/1995 | Huang | 439/419 |
| 5,446,640 | 8/1995 | Lin | 439/419 |
| 5,547,392 | 8/1996 | Cheng et al. | 439/419 |
| 5,586,904 | 12/1996 | Huang | 439/419 |
| 5,743,758 | 4/1998 | Cheng et al. | 439/419 |
| 5,860,830 | 1/1999 | Wu | 439/419 |

*Primary Examiner*—Lincoln Donovan
*Assistant Examiner*—Hae Moon Hyeon
*Attorney, Agent, or Firm*—Varndell & Varndell PLLC

[57] ABSTRACT

A lamp socket, which includes a socket body, a socket cap fastened to the socket body to hold down an electric wire, a first terminal and a second terminal mounted in respective terminal mounting slots in the socket body and pierced through the insulator of the electric wire into contact with a respective conductor in the electric wire, wherein the first terminal has a first vertical section positioned in one terminal mounting slot at the socket body and terminating in a pointed tip for contacting with one conductor in the electric wire, a second vertical section positioned in a locating blind hole inside the socket body, and a horizontal section connected between the first vertical section and the second vertical section and attached to the inside wall of the socket body.

1 Claim, 7 Drawing Sheets

LAMPSOCKET WITH NON-DEFORMING TERMINAL

BACKGROUND AND SUMMARY OF THE INVENTION

In a regular lamp socket, as shown in FIG. 1, the positive pole terminal comprises a sloping contact portion obliquely extended from its bottom end. When the base of the lamp bulb is threaded into the socket body, the tip contact is forced into contact with the sloping contact portion of the positive pole terminal. Because the sloping contact portion of the positive pole terminal is spaced from the top wall of the socket body by a raised portion at the top wall, a child can use a rod member to force the positive pole terminal out of place. FIGS. 2 and 3 show two another different lamp sockets according to the prior art. According to these lamp sockets, the positive terminal has a horizontal middle section suspended inside the sokcet body. When the base of a lamp bulb is threaded into the socket body, the tip contact of the lamp bulb is forced into contact with the horizontal middle section. However, because the horizontal middle section is suspended in a hole which receives the positive pole terminal, the horizontal middle section tends to be deformed upon installation of the lamp bulb (see FIGS. 4 and 5). When the lamp bulb is damaged and replaced with a new one, the tip contact of the newly installed lamp bulb may be unable to contact the deformed horizontal middle section of the positive pole terminal positively.

The present invention has been accomplished to provide a lamp socket which eliminates the drawbacks of the aforesaid Prior art lamp sockets. According to the present invention, the positive pole terminal comprises a first vertical section positioned in one terminal mounting slot at the top wall of the socket body and terminating in a pointed tip for piercing through the insulator of the electric wire mounted on the outside of the top wall of the socket body, a second vertical section positioned in a locating blind hole on the inside of the top wall of the socket body, and a horizontal section connected between the first vertical section and the second vertical section and attached to the top wall inside the socket body. Because the horizontal section of the positive pole terminal is firmly supported on the top wall inside the socket body, it will not be deformed upon installation of a lamp bulb in the socket body, and the tip contact of the installed lamp bulb can be maintanined in contact with the positive pole terminal positively.

DETAILED DESCRIPTION OF THE PREFERRED EMBODIMENT

Figure 1:
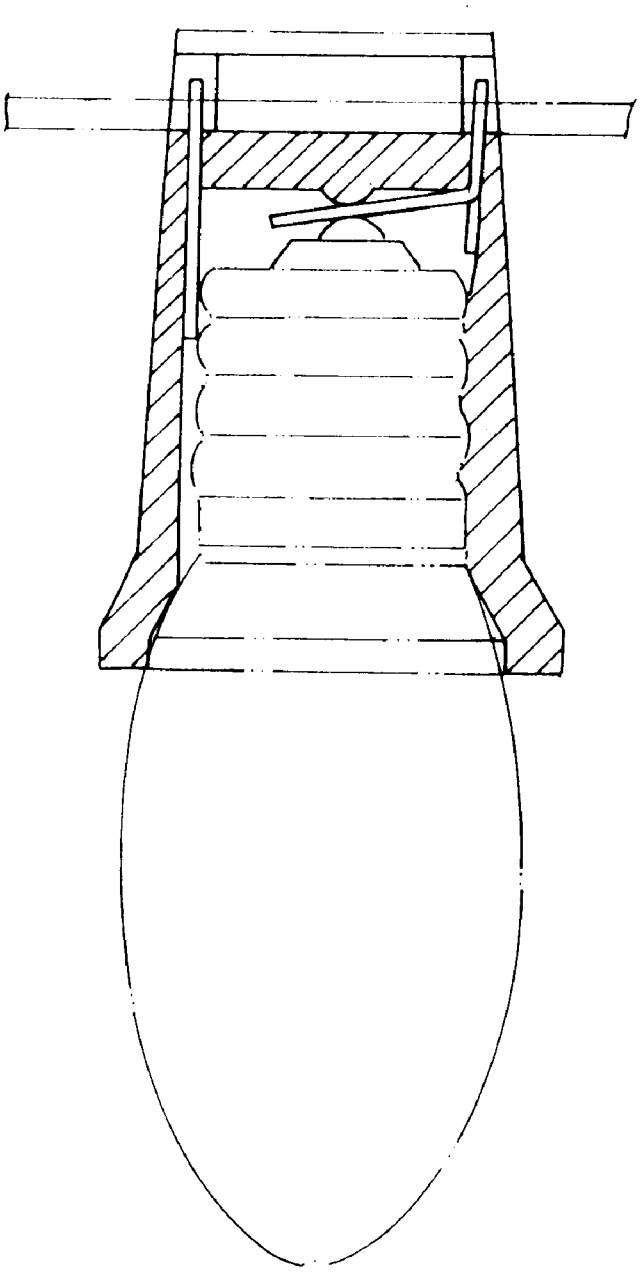
Fig. 1 PRIOR ART
FIG. 1 is a sectional view of a lamp socket according to the prior art.
Figure 2:
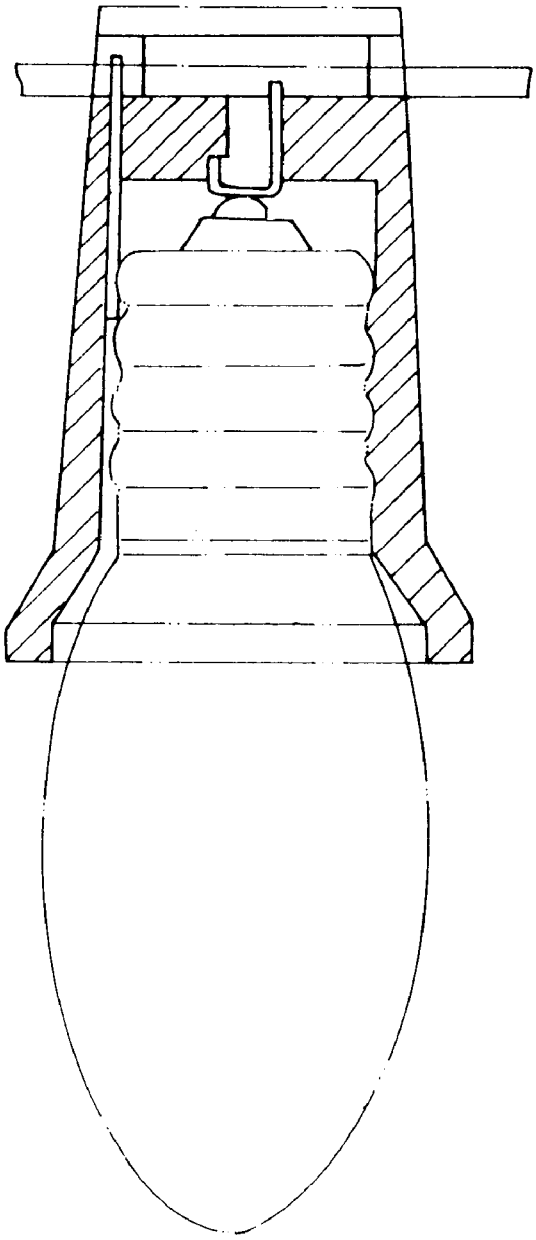
Fig. 2 PRIOR ART
FIG. 2 is a sectional view of another structure of lamp socket according to the prior art.
Figure 3:
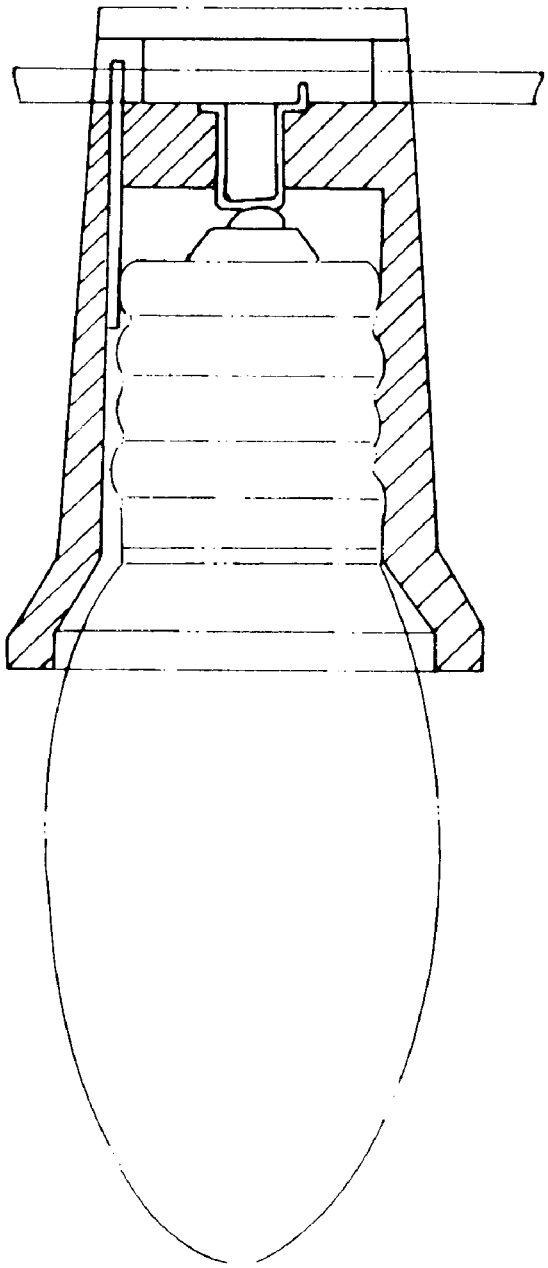
Fig. 3 PRIOR ART
FIG. 3 is a sectional view of still another structure of lamp socket according to the prior art.
Figure 4:
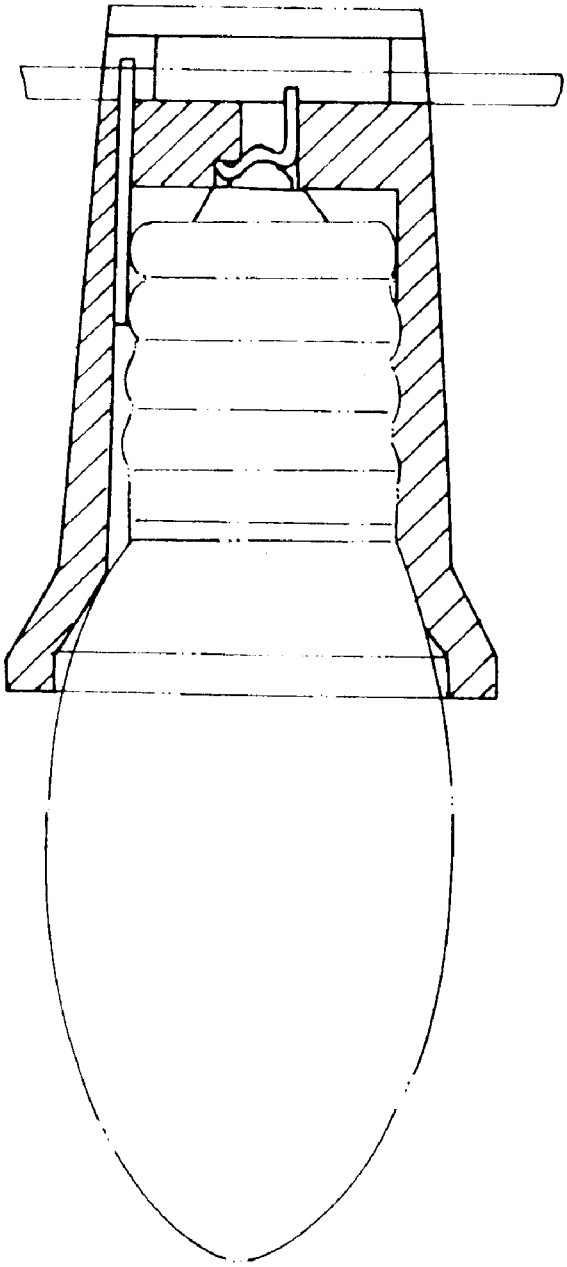
Fig. 4 PRIOR ART
FIG. 4 is similar to FIG. 2 but showing the positive pole terminal deformed.
Figure 5:
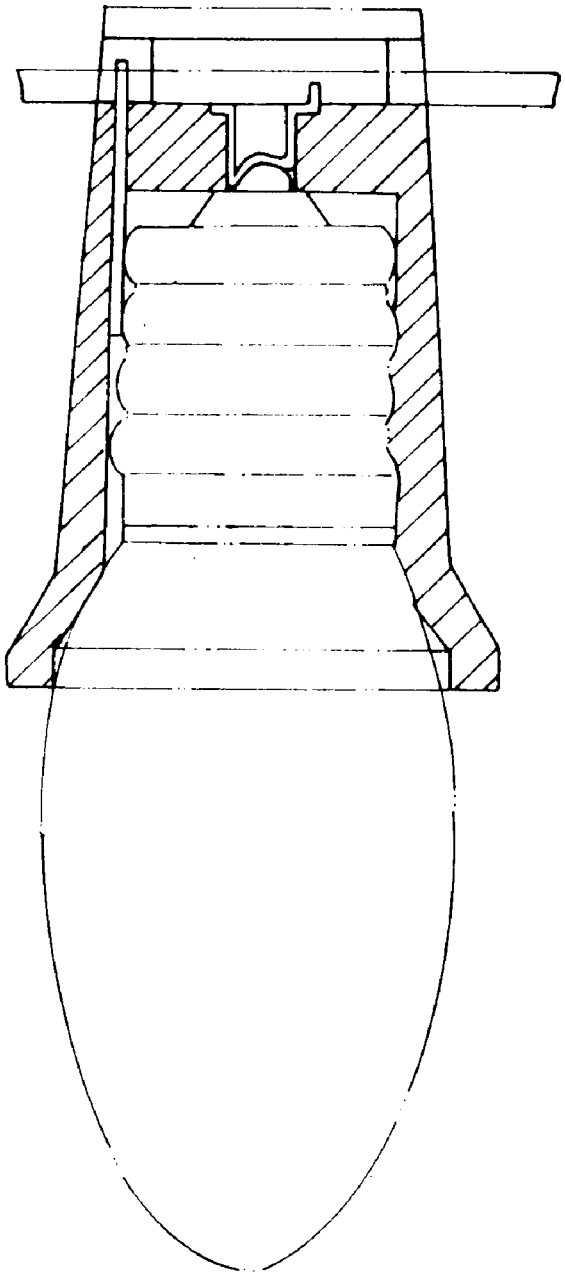
Fig. 5 PRIOR ART
FIG. 5 is similar to FIG. 3 but showing the positive pole terminal deformed.
Figure 6:
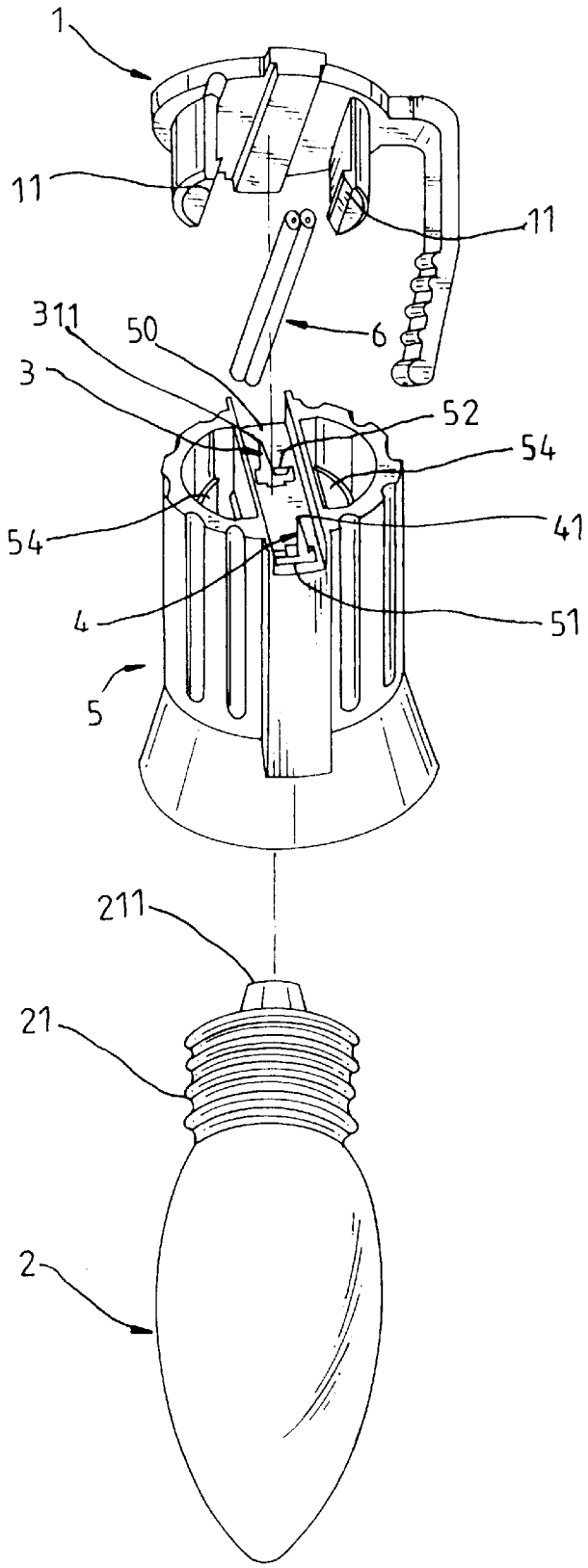
FIG. 6 is an exploded view of a lamp socket according to the present invention.

Referring to FIGS. from 6 through 8, a lamp socket in accordance with the present invention is generally comprised of a socket body 5, a socket cap 1, a first terminal 3, and a second terminal 4.

The socket cap 1 is covered on the socket body 5 to hold down an electric wire 6, having two downward hooks 11 respectively hooked in the socket body 5. The first terminal 3 comprises a first vertical section 31 having a top end terminating in a pointed tip 311 having a bottom end, a second vertical section 32 having a top end and a bottom end, a section 33 connected between the bottom end of the the first vertical section 31 and the bottom end of the second vertical section 32. The second terminal 4 has end terminating in a pointed tip 41. The socket body 5 comprises a first terminal mounting slot 52, which receives the first vertical section 31 of the first terminal 3, a second terminal mounting slot 51, which receives the second terminal 4, a transverse wire groove 50 across the top side wall (or transverse wall) thereof, which receives the electric wire 6, and two retaining portions 54 bilaterally disposed on the side for engagement with the downward hooks 11 of the socket cap 1. When the socket cap 1 fastened to the socket body 5, the socket cap 1 imparts a downward pressure to the electric wire 6 against the pointed tips 311 and 41, causing the pointed tips 311 and 41 to pierce through the insulator of the electric wire 6 into contact with a respective conductor in the electric wire 6. When the base of a lamp bulb 2 is threaded into the socket body 5, the ring contact 21 and the tip contact 211 are respectively forced into contact with the second terminal 4 and the horizontal section 33 of the first terminal 3 respectively, causing the lamp bulb 2 and the electric wire 6 to be electrically connected.

Figure 7:
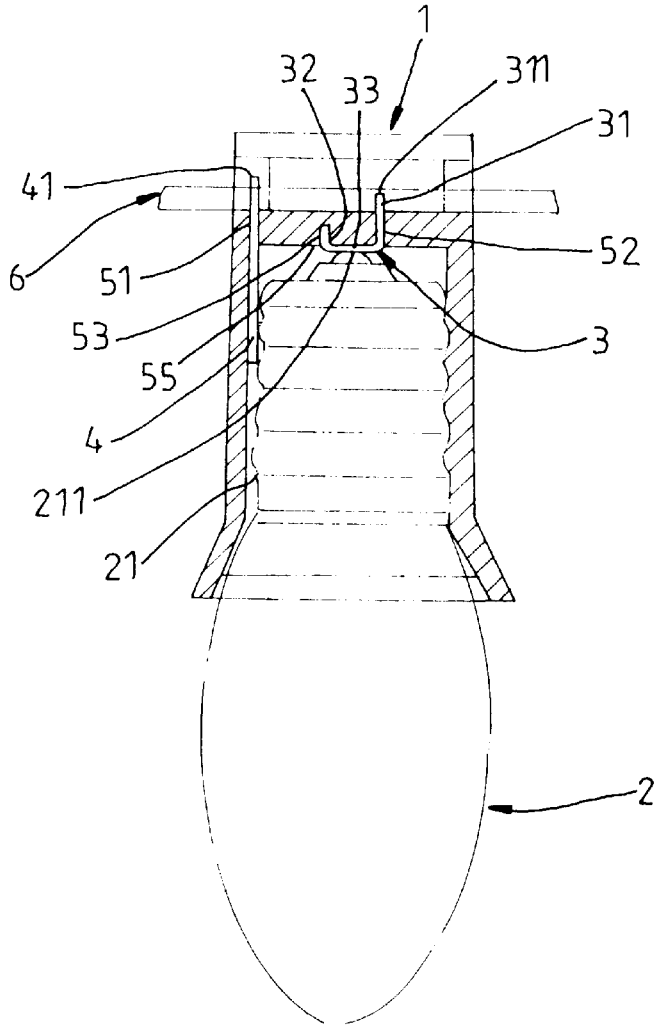
FIG. 7 is a sectional assembly view of the lamp socket according to the present invention.
Figure 8:
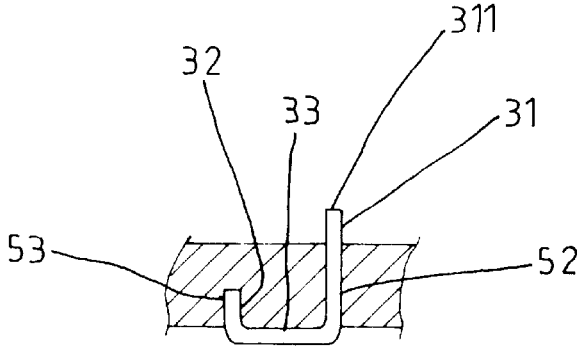
FIG. 8 is an enlarged view of a part of FIG. 7, showing the positioning of the first terminal in the top wall of the socket body.

Referring to FIGS. 7 and 8 again, the socket body 5 further comprises a locating blind hole 53 on the inside of the top wall (or transverse wall) 55 thereof at the top adjacent to the first terminal mounting slot 52 for the positioning of the second vertical section 32 of the first terminal 3, for enabling the horizontal section 33 of the first terminal 3 to be closely attached to the top wall 55. When the lamp bulb 2 is threaded into the socket body 5, the tip contact 211 of the lamp bulb 2 is pressed on the horizontal section 33 of the first terminal 3, and therefore the first terminal 3 is firmly retained in position.

As indicated above, the first vertical section 31 and second vertical section 32 of the first terminal 3 are respectively positioned in the first terminal mounting slot 52 and the locating blind hole 53 in the socket body 5, enabling the horizontal section 33 to be maintanined in close contact with the top wall (or transverse wall) 55 of the socket body 5. Because the horizontal section 33 is firmly supported on the top wall 55 of the socket body 5, it will not be forced to deform easily, and a positive contact between the first terminal 3 and the tip contact 211 of the lamp bulb 2 is maintained. Furthermore, because the horizontal section 33 is closely attached to the top wall 55 of the socket body 5, the first terminal 3 can not easily be opened by a child with a rod member of the like. Therefore, the lamp socket is safe in use.

I claim:

1. A lamp socket comprising a socket body, an electric wire, and a socket cap holding said electric wire in said socket body;

said socket body including an integrally formed hollow cylinder and a transverse wall, said transverse wall extending across one end of said hollow cylinder and splitting said one end of said hollow cylinder into two retaining portions, said transverse wall having an inside and an outside, a wire groove provided in said outside of said transverse wall, a first terminal mounting slot passing through a middle portion of said transverse wall in communication with said wire groove, a second terminal mounting slot passing through said transverse wall in communication with said wire groove and arranged adjacent said hollow cylinder, a locating blind hole arranged on said inside of said transverse wall in said middle portion thereof, said blind locating hole partly passing through said transverse wall and located adjacent said first terminal mounting slot;

said electric wire mounted in said wire groove of said socket body; said socket cap including two hooks respectively received in said two retaining portions of said socket body for securing said socket cap and socket body together and holding said electric wire within said wire groove, said electric wire including first and second conductors respectively surrounded by an insulator;

a first terminal mounted in said first terminal mounting slot for contacting a tip contact of a lamp bulb, said first terminal having a J-shape with a first vertical section with a top and a bottom, a second vertical section with a top and a bottom, and a horizontal section joining said bottoms of said first and second vertical sections; said first vertical section having a length longer than a length of said second vertical section, said top of said second vertical section being received in said blind hole of said transverse wall, said horizontal section abutting said transverse wall without permitting any spacing between said transverse wall and said horizontal section along an entire length of said horizontal section, said first vertical section passing through said first terminal mounting slot of said transverse wall, said top of first terminal having a pointed tip piercing through said insulator of said electric wire and contacting said first conductor of said electric wire; and a second terminal mounted in said second terminal mounting slot for contacting a ring contact of a lamp bulb, said second terminal having a pointed tip at one end thereof piercing through said insulator of said electric wire into contact with said second conductor of said electric wire.

* * * * *